United States Patent [19]

Otto et al.

[11] Patent Number: 4,631,866

[45] Date of Patent: Dec. 30, 1986

[54] COMPOSITE NON-HANDED DOOR JAMB CONSTRUCTION

[75] Inventors: Ronald F. Otto; John J. Kempel, both of West Branch, Mich.

[73] Assignee: Garland Manufacturing Co., West Branch, Mich.

[21] Appl. No.: 745,862

[22] Filed: Jun. 17, 1985

[51] Int. Cl.[4] ..... E06B 1/04; E05D 7/02

[52] U.S. Cl. ..... 49/504; 49/382; 292/341.19

[58] Field of Search ..... 49/504, 382, 505; 292/341.19, 341.18, DIG. 60; 52/217, 211, 204

[56] References Cited

U.S. PATENT DOCUMENTS

| | | | |
|---|---|---|---|
| 3,591,985 | 7/1971 | Coppins | 49/504 |
| 3,783,559 | 1/1974 | Yocum et al. | 49/504 |
| 3,889,423 | 6/1975 | Begin | 49/504 |
| 4,014,146 | 3/1977 | Dimascio et al. | 52/217 X |
| 4,295,299 | 10/1981 | Nelson | 49/504 |
| 4,307,543 | 12/1981 | Schulthess | 49/504 X |
| 4,453,752 | 6/1984 | McKann | 292/341.19 |

FOREIGN PATENT DOCUMENTS

| | | | |
|---|---|---|---|
| 284188 | 1/1928 | United Kingdom | 292/341.19 |

*Primary Examiner*—Philip C. Kannan

*Attorney, Agent, or Firm*—Harness, Dickey & Pierce

[57] ABSTRACT

An improved door jamb construction adapted to be used with left or right-handed door installations and which further accommodates a broad range of types and configurations of security deadbolt devices. The door jamb construction according to this invention further features excellent thermal insulation properties since it is filled with a foam insulating material. The flexibility advantages according to this invention are achieved by providing a lock jamb structure having several removable cover plates which can be installed in various positions. A deadbolt sliding bolt hole cover plate is provided having several holes with removable center sections and which can be inverted, thereby maximizing the number of deadbolt sliding bolt locations which can be accommodated.

26 Claims, 13 Drawing Figures

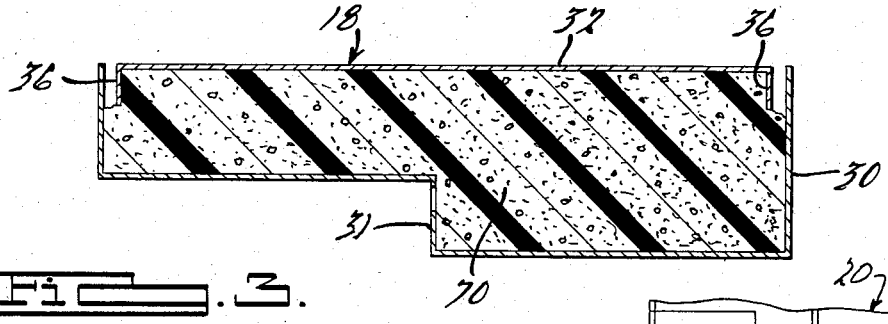
FIG. 3.
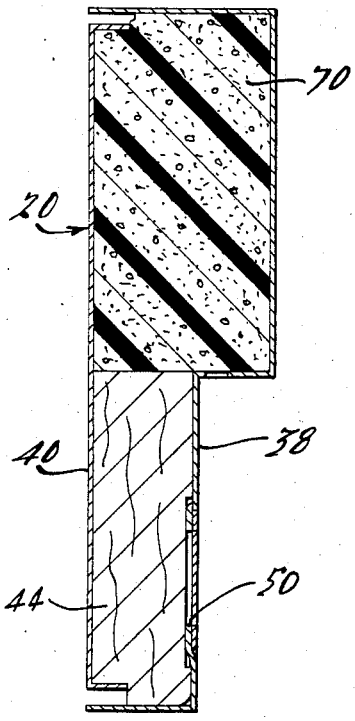
FIG. 4.
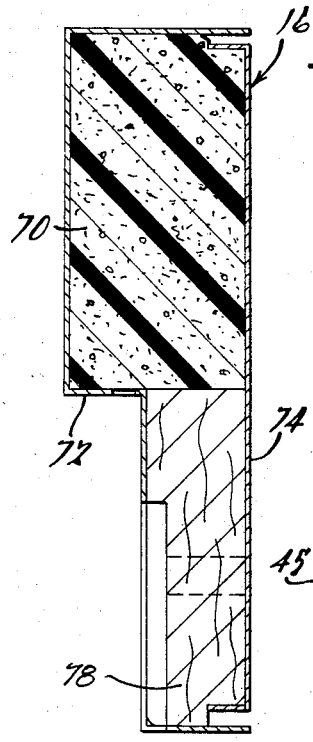
FIG. 6.
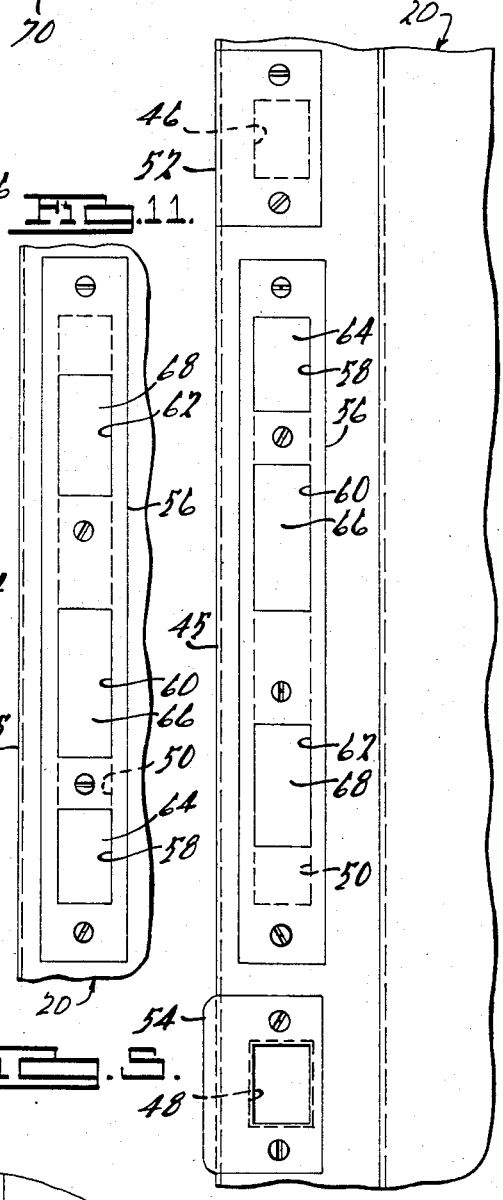
FIG. 11.
FIG. 5.
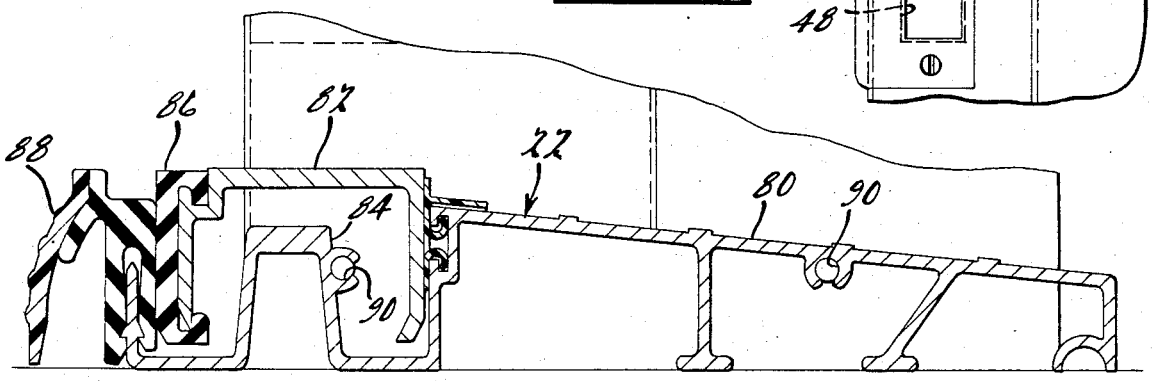
FIG. 7.

COMPOSITE NON-HANDED DOOR JAMB CONSTRUCTION

BACKGROUND AND SUMMARY OF THE INVENTION

This invention relates to a door jamb structure and particularly for such a structure adapted for installation in association with a pedestrian doorway of a building structure.

In modern building construction, pedestrian doors are generally installed using a pre-fabricated door jamb structure. Often it is necessary for door jamb structures to be ordered specifically for right-hand or left-hand opening door installations, or substantial reworking of a door jamb is necessary to convert it from one opening direction to the other. Moreover, pedestrian entrance doors are often installed with security devices such as deadbolt locks. Since it is difficult or impossible to anticipate the precise type and configuration of deadbolt security locking system which will be installed in the door, it is frequently necessary to machine, rework or specifically order a door jamb for a particular door using a particular security device. Additionally, many of the door jamb constructions according to the prior art are poorly insulated and therefore contribute to building heat and cooling losses.

In view of the foregoing, it is an object of this invention to provide a door jamb construction particularly adapted for building pedestrian doorways which is easily converted for use with either left-hand or right-hand opening door installations. It is a further object of this invention to provide such a door jamb construction which is easily adapted for use with various configurations of deadbolt type security lock devices. It is an additional object of this invention to provide a door jamb construction having excellent thermal insulating properties. It is yet another object of this invention to provide a door jamb construction featuring simple construction and which can be produced and installed inexpensively.

The above objects according to this invention are achieved by employing a door jamb construction having a sheet metal encasement which is preferably filled with a foam insulating material. Adaptability for right and left-handed opening door installations and various security devices is achieved through employing removable plates on one of the door jamb surfaces which can be quickly and easily adapted for the particular installation requirements of the user.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 3 is a cross-sectional view taken along line 3—3 of FIG. 2 particularly showing the configuration of the door jamb header;

FIG. 4 is a cross-sectional view taken along line 4—4 of FIG. 2 particularly showing the configuration of the lock jamb;

FIG. 5 is a partial elevational view taken in the direction of line 5 of FIG. 2 particularly showing the configuration of the deadbolt striker plate and lock striker plate;

FIG. 6 is a cross-sectional view taken along line 6—6 of FIG. 2 particularly showing the configuration of the hinge jamb;

FIG. 7 is a cross-sectional view taken along line 7—7 of FIG. 2 particularly showing the configuration of the threshold structure;

FIG. 11 is a partial elevational view taken in the direction of line 5 of FIG. 2 showing the deadbolt striker plate in a position inverted from the position shown in FIG. 5;

DETAILED DESCRIPTION OF THE INVENTION

Figure 1:
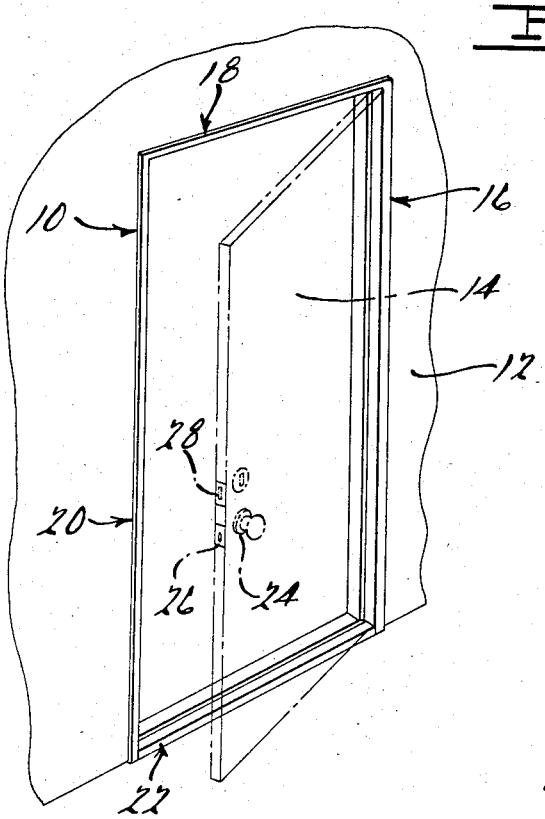
FIG. 1 is a pictorial view of a door jamb construction in accordance with this invention shown installed within a wall of a building with a door structure shown in phantom lines installed thereto.

FIG. 1 illustrates door jamb construction 10 installed within a building wall 12 and employed to support door 14. Door 14 is attached for pivoting about hinge jamb 16 by two or more spaced apart hinge assemblies (not shown). Door jamb construction 10 further comprises header 18, lock jamb 20, and threshold 22. Door 14 typically includes an entrance lockset 24 having a sliding locking bolt 26 which engages with lock jamb 20 to maintain door 14 in a closed position. Door 14 may further include a deadbolt security device 28 which also engages with lock jamb 20 to provide additional security. Typically, entrance lockset 24 is mounted below the horizontal centerline of door 14 to locate it in a convenient position to be grasped by pedestrians.

Figure 2:
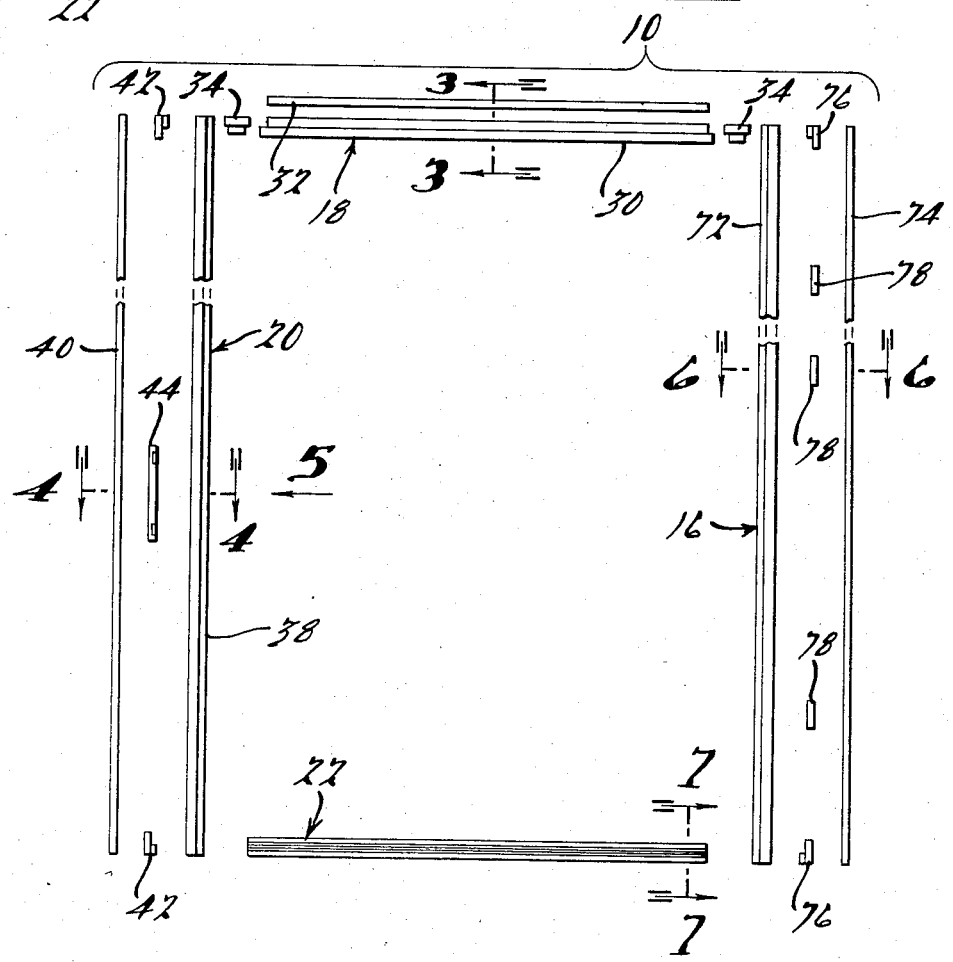
FIG. 2 is an exploded side elevational view of the door jamb construction in accordance with this invention.

FIGS. 2 through 7 and 11 provide detailed views of the configuration of components making up door jamb construction 10. Door jamb 10 generally comprises a number of elongated components having metal exterior surfaces with hollow interior cavities which are filled with a plastic foam material 70, such as polystyrene or polyurethane foam, which provides excellent thermal insulation properties. FIG. 2 is an exploded view of door jamb 10 showing the various constituent parts thereof. Header section 18 is comprised of two metal pieces, header inner plate 30 and backer plate 32, which are assembled to define a hollow interior cavity. Plates 30 and 32 are assembled by providing a pair of header blocks 34 which are positioned at the ends of the plates and act to enclose the remainder of the interior cavity of header 18. Header blocks may be made from numerous materials such as wood or plastics. Header blocks 34 are preferably securely fastened to plates 30 and 32 using adhesive compounds such as so-called "hot melt" adhesives, which are applied at elevated temperatures and freeze at room temperatures to bond the components together. FIG. 3 is a cross-sectional view through header 18 showing the configurations of plates 30 and 32. As shown by that figure, backer plate 32 includes a pair of flanges 36 which are spaced slightly from header inner plate 30. Such spacing provides a desirable thermal conduction break which inhibits the transfer of heat between the interior and exterior surfaces of header 18. Header inner plate 30 forms a wall portion 31 extending in the direction of door 14 when closed. Preferably, plastic foam material 70 is injected into the interior cavity of header 18 after header blocks 34 are installed, so that the foam completely fills the interior cavity. Any excess foam exits through the gaps between plates 30 and 32 or through openings in the plates provided for that purpose.

Lock jamb 20, like header 18, is comprised of a pair of attached plates; lock jamb inner plate 38, and backer plate 40. Plates 38 and 40 have a configuration in cross sectional which is identical with plates 30 and 32 of header section 18. A pair of lock jamb blocks 42 are installed at the axial ends of lock jamb 20 and are positioned there preferably by adhesive bonding techniques. Lock jamb 20 further includes an intermediate block 44 which serves to prevent the flow of foam material 70 injected into the interior of lock jamb 20 from passing through the number of apertures which are provided in the lock jamb necessary to accommodate deadbolt and entrance lockset sliding bolts. As best shown in FIG. 5, lock jamb 20 forms a depressed region 45 within which a series of holes and slots are provided, including a pair of entrance lockset sliding bolt holes 46 and 48 and elongated deadbolt sliding bolt hole 50. A plate 52 is provided which encloses either of holes 46 or 48 which are not used. For the installation shown by the figures, hole 46 would be enclosed by plate 52, whereas a striker plate 54 is affixed to lock jamb plate 38 surrounding hole 48. Striker plate 54 includes a hole which receives entrance lockset bolt 26. Plates 52 and 54 are attached to lock jamb inner plate 38 by using threaded fasteners.

In order to accommodate a variety of deadbolt 28 types and configurations, deadbolt striker plate 56 is provided which is installed over deadbolt sliding bolt hole 50. In accordance with a principal feature of this invention, deadbolt striker plate 56 includes several perforated holes 58, 60, and 62 with center sections 64, 66, and 68. Center sections 64, 66, and 68 can be conveniently removed to provide an open hole through which a deadbolt sliding bolt can pass. Deadbolt striker plate 56 is attached to lock jamb 20 preferably using a plurality of threaded fasteners. In order to provide for a variety of deadbolt configurations, it is preferred that holes 58, 60, and 62 are spaced asymmetrically with respect to the vertical centerline of deadbolt striker plate 56 so that a different pattern of holes is presented if the lock plate is installed in an inverted position. In accordance with the embodiments shown wherein deadbolt strike plate 56 has three holes 58, 60, and 62, inversion of lcok plate 56, as shown in FIG. 11, produces a total of six different deadbolt sliding bolt locations, thereby providing maximum flexibility in using door jamb construction 10 with various configurations of doors and deadbolt security devices.

The provision of a pair of entrance lockset sliding bolt holes 46 and 48 enables lock jamb 20 to be installed either for a left or right-hand opening door. As shown in FIG. 1, lock jamb 20 is installed in a manner providing a right-hand opening door. For this application, entrance lockset bolt hole 48 would be used to accommodate the entrance lockset sliding bolt. If, however, left-handed installation is desired, lock jamb 20 would be inverted and installed at the opposite end of header 18, and entrance lockset hole 46 would be used to accommodate entrance lockset sliding bolt 26. The above-described configuration for lock jamb 20 provides the capabilities for opposite handed installation as well as accommodating a variety of various deadbolt lockset configurations. Lock jamb 20 is preferably attached to header section 18 by using staples or threaded fasteners through lock jamb block 42 and into header block 34.

Door jamb construction 10 further comprises hinge jamb 16 which is formed by attaching hinge jamb inner plate 72, backer plate 74, and a pair of hinge jamb blocks 76. Two or more hinge assemblies (not shown) are installed onto hinge jamb inner plate 72 for enabling hinging of door 14. In order to provide reinforcements for hinge jamb 16 in the region of installation of the hinge assemblies, additional hinge reinforcing blocks 78 are installed. Blocks 78 further enable use of screw fasteners which are typically employed to fasten the hinge assemblies to firmly engage the jamb structure. Like the previously described hinge jamb components, hinge jamb 16 is preferably filled with plastic foam material 70. Hinge jamb 16 is attached to header 18 using staples or threaded fasteners through block 76 and into block 34.

Door jamb structure 10 further comprises threshold 22 which is made in accordance with prior art designs. As shown in FIG. 7, threshold 22 is comprised of a number of extruded channel members which are assembled including sill plate 80 and a pair of channels 82 and 84. Additionally, barrier strip 86 and threshold trim 88 are installed. Sill plate 80 and channel 84 define elongated fastener receiving channels 90 which enable hinge jamb 16 and lock jamb 20 to be threadingly attached to threshold 22.

Figure 8:
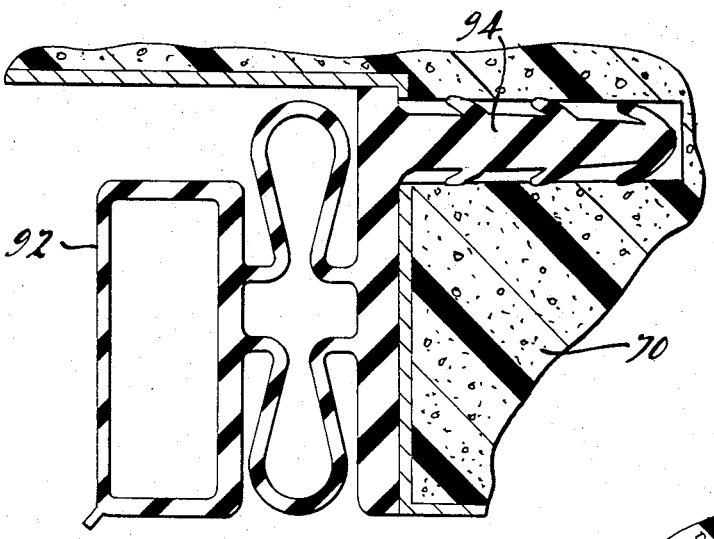
FIG. 8 is a cross-sectional view showing the configuration of a weather strip particularly useful for installation on the lock jamb and header door jamb components, and further showing one embodiment of a means for attaching a weather strip to a door jamb.
Figure 9:
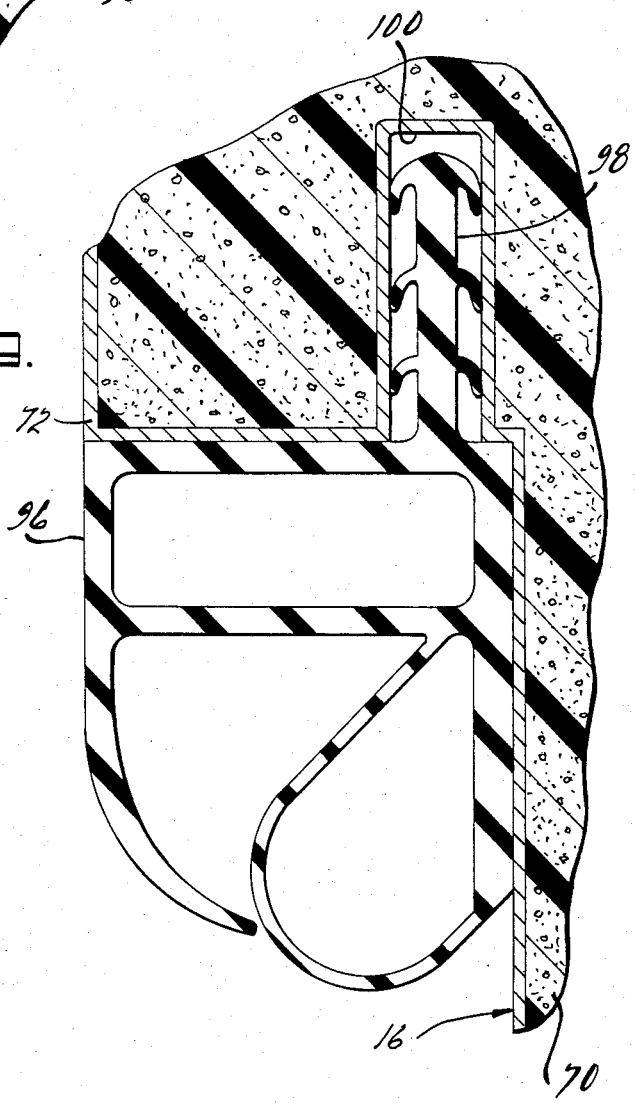
FIG. 9 is a cross-sectional view of an installed weather strip of the type particularly adapted for use along the hinge jamb portion and further showing an alternate embodiment for a means for attaching such a weather strip to a door jamb.

In order to provide a secure, weatherproof fitting of door 14 within door jamb structure 10, several weather strips are employed which firmly seal against door 14. A pair of such weather strips are shown with by FIGS. 8 and 9. Weather strip 92, shown in FIG. 8, is of prior art configuration and is adapted for sealing against the surfaces of door 14 along lock jamb 20 and header 18. Weather strip 92 preferably includes an elongated "Christmas tree" flange 94 which enters into the interior cavity of the associated door jamb component. In accordance with the embodiment shown in FIG. 8, provision for receiving flange 94 is provided by simply making a saw cut through the outer surface of the door jamb and into the interior. This method provides the advantage that it produces a discontinuity in the metal surface between the inside and outside portions of door jamb construction 10. FIG. 9 illustrates weather strip 96 according to prior art designs of the type particularly suited for installation along hinge jamb 16. This figure, however, further illustrates an alternate embodiment for means for retaining a weather strip. Weather strip 96 further includes retainer flange 98 having the "Christmas tree" configuration. Weather strip retainer flange 98 is, however, installed within channel 100 formed by reverse bending the metal surface of hinge flange inner plate 72.

Figure 10:
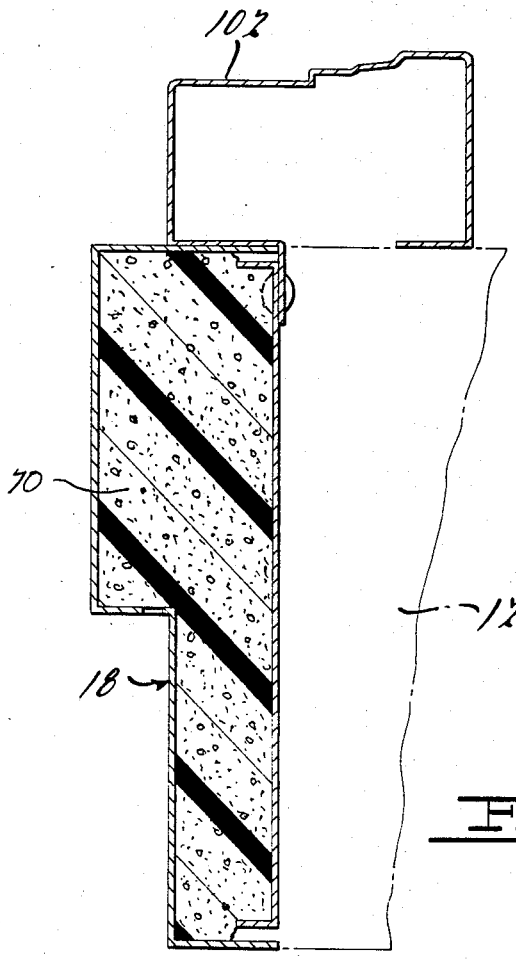
FIG. 10 is a cross-sectional view of an alternate embodiment of a door construction according to this invention which features the addition of a brick mold.

FIG. 10 illustrates an additional component which can be added to door jamb construction 10 to enhance its appearance. Brick mold 102, is provided and is attached along hinge jamb 16, lock jamb 20, and header 18. Brick mold 102 provides a pleasing aesthetic appearance for the exterior of door jamb construction 10 and is preferably installed using threaded fasteners, rivets, or other mechanical fasteners or adhesives. The various components making up brick mold 102 meet at the corner junctions between header 18 and jamb sections 16 and 18 and preferably have mitered joint edges.

Figure 12:
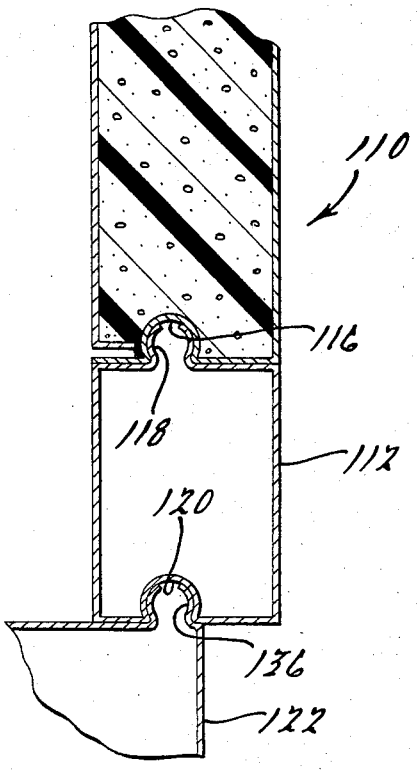
FIG. 12 is a partial cross-sectional view of an alternate embodiment of a door construction according to this invention which features a jamb extension.

FIG. 12 illustrates a door jamb construction 110 in accordance with a modified embodiment of this invention which further incorporates jamb extension 112. The inner plate of any of the door jamb sections 30, 38, or 72 is conformed to define a generally circular pocket 116. Jamb extension 112 is a box-shaped metal component defining protruding legs 118 adapted to be closely received by pocket 116. The configuration of pocket 120 and legs 136 enables extension 112 to be snapped into engagement with the door jamb such that it is firmly attached thereto. Jam extension 112 further defines pocket 120 identical to pocket 116 which enables brick mold 122 to be attached using legs 136 or can be employed to attach additional jamb extensions 112. Jam extension 112 may have any dimension desired, thereby enabling door jamb construction 110 to accommodate various wall thicknesses or desired aesthetic appearances.

Figure 13:
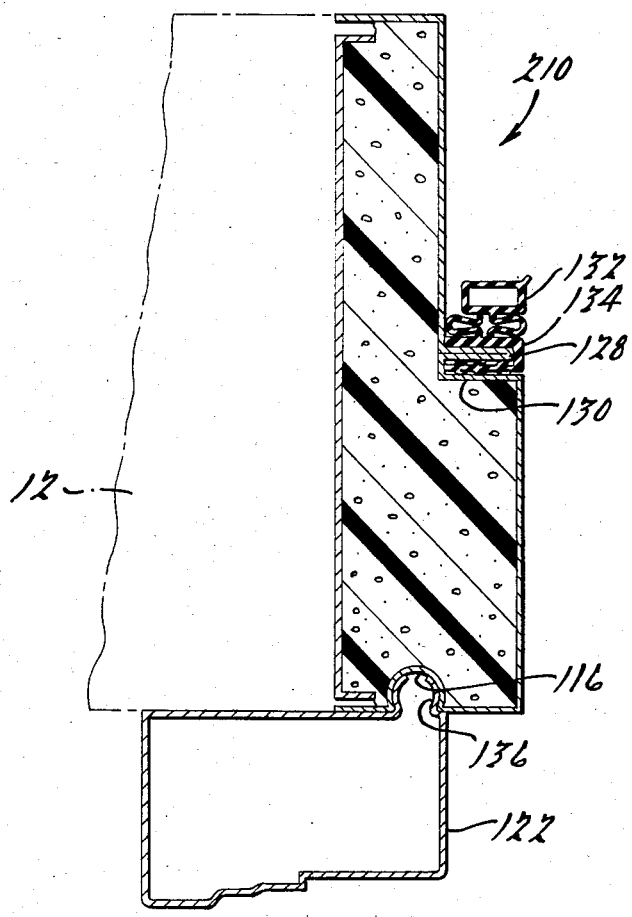
FIG. 13 is a partial cross-sectional view of an alternate embodiment of a door jamb construction according to this invention which features an alternate means for attaching a weather strip to a door jamb.

FIG. 13 illustrates an alternate embodiment of a means for attaching a weather strip to a door jamb 210. For this embodiment, the inner plate of any of the door jamb components 30, 38, or 72 is conformed to define wall 128 which is spaced from the wall 130. Wall 128 is preferably formed by reverse bending the metal which makes up the inner plate. Weather strip 132 has a carrier portion 134 adapted to grippingly engage wall 128. The door jamb construction 210 shown in FIG. 12 is further conformed to define a pocket 116 as shown in FIG. 12. This Figure, however, illustrates pocket 116 being used as directly receiving the protruding legs 136 of brick mold 122.

While the above description constitutes the preferred embodiments of the present invention, it will be appreciated that the invention is susceptible to modification, variation and change without departing from the proper scope and fair meaning of the accompanying claims.

What is claimed is:

1. A door jamb construction for mounting a hinged door to a building wall adapted to accommodate an entry lockset and a variety of deadbolt security devices, said door jamb adaptable for either right-hand or left-hand opening doors, comprising;

a header section, a hinge jamb section, a threshold, a lock jamb section having an elongated center hole for receiving a sliding bolt of said deadbolt security device, a pair of entry lockset receiving holes displaced from the center of said lock jamb section such that one of said receiving holes is positioned in said lock jamb section on one side of said center hole and the other receiving hole is positioned on the other side of said center hole, an entrance lockset receiving hole cover plate adapted to cover either of said entry lockset receiving holes, thereby enabling said lock jamb to be attached to either end of said header section providing right-hand opening or left-hand opening operation of said door, and a deadbolt sliding bolt hole cover plate having one or more areas having removable center sections, said area defining a hole when said center section is removed and adapted to receive the sliding bolt of said deadbolt security device, said area being located asymmetrically with respect to the horizontal centerline of said deadbolt sliding bolt hole cover plate so that said deadbolt sliding bolt hole cover plate presents different positions of said area when in a first position as compared with a second inverted position, whereby said deadbolt sliding bolt hole cover plate accommodates a variety of types and configurations of said deadbolt security devices.

2. The door jamb construction according to claim 1 wherein said cover plates are affixable to said lock jamb using threaded fasteners.

3. The door jamb construction according to claim 1 wherein said deadbolt sliding hole cover plate has three of said areas.

4. The door jamb construction according to claim 1 further comprising a groove cut in said header, hinge jamb, and lock jamb sections and a weather strip installed in said groove.

5. The door jamb construction according to claim 1 further comprising a reverse bent pocket formed by said header section, said hinge jamb section, and said lock jamb section, and a weather strip installed in said pocket.

6. The door jamb construction according to claim 1 further comprising, a brickmold attached to said header section, said hinge jamb section, and said lock jamb section.

7. The door jamb construction according to claim 1 further comprising a wall formed by reversely bending said header, hinge jamb and lock jamb sections, and a weather strip carried by said wall.

8. The door jamb construction according to claim 1 further comprising: a pocket formed by said header, hinge jamb and lock jamb sections.

9. The door jamb construction according to claim 8 further comprising an extension section having legs adapted to be engaged by said pocket.

10. The door jamb construction according to claim 8 further comprising a brickmold having legs adapted to be engaged by said pocket.

11. The door jamb construction according to claim 10 wherein said extension section includes a pocket such that additional extension sections or said brickmold may be attached to said extension section.

12. A door jamb construction adapted for mounting a hinged door to a building wall, said door jamb accommodating deadbolt and entry lockset sliding bolts, comprising;

a header section having an inner plate and an interfitting backer plate, said header section plates defining a hollow interior cavity, a hinge jamb section having an inner plate and an interfitting backer plate, said hinge jamb section plates defining a hollow interior cavity, a lock jamb section having an inner plate and an interfitting backer plate, said lock jamb section plates defining a hollow interior cavity, said lock jamb inner plate having a central hole for receiving said deadbolt sliding bolt and having a pair of holes for receiving said entry lockset sliding bolt, said receiving holes positioned on said lock jamb section such that one receiving hole is on one side of said central hole and the other receiving hole is on the other side of said central hole, an entry lockset receiving hole cover plate adapted to cover either of said entry lockset receiving holes, thereby enabling said lock jamb to be attached to either end of said header section providing right-hand opening or left-hand opening operation of said door, and a deadbolt sliding bolt hole cover plate having one or more areas having removable center sections, said area defining a hole when said center section is removed and adapted to receive the sliding bolt of said deadbolt security device, a perforated area being located asymmetrically with respect to the horizontal centerline of said deadbolt sliding bolt hole cover plate so that said deadbolt sliding bolt hole cover plate presents different positions of said area when in a first position as compared to a second inverted position, whereby said deadbolt sliding bolt hole cover plate accommodates a variety of types and configurations of said deadbolt security devices.

13. The door jamb construction according to claim 12 wherein said cover plates are affixable to said lock jamb using threaded fasteners.

14. The door jamb construction according to claim 12 wherein said deadbolt sliding hole cover plate has three of said areas.

15. The door jamb construction according to claim 12 further comprising grooves cut in said header section inner plate, said hinge jamb section inner plate, said lock jamb section inner plate, and one or more weather strips installed in said grooves.

16. The door jamb construction according to claim 12 further comprising revese bent pockets formed by said header section inner plate, said hinge hamb section inner plate, and said lock jamb section inner plate, and one or more weather strips installed in said pockets.

17. The door jamb construction according to claim 12 further comprising a wall formed by reversely bending said header, hinge jamb and lock jamb sections, and a weather strip carried by said wall.

18. The door jamb construction according to claim 12 further comprising, a brickmold attached to said header section, said hinge jamb section, and said lock jamb section.

19. The door jamb construction according to claim 12 wherein said header section, said hinge jamb section, and said lock jamb section are filled with an insulating foam material.

20. The door jamb construction according to claim 12 further comprising: a pocket formed by said header, hinge jamb and lock jamb sections.

21. The door jamb construction according to claim 20 further comprising an extension section having legs adapted to be engaged by said pocket.

22. The door jamb construction according to claim 20 further comprising a brickmold having legs adapted to be engaged by said pocket.

23. The door jamb construction according to claim 22 wherein said extension section includes a pocket such that additional extension sections or said brickmold may be attached to said extension section.

24. The door jamb construction according to claim 12 further comprising; a block disposed at each of the axial ends of said header section, said hinge jamb section and said lock jamb section, said blocks enclosing said interior cavities of said sections.

25. The door jamb construction according to claim 24 wherein said blocks are bonded to said inner plates and said backer plates.

26. The door jamb construction according to claim 24 wherein said inner plates and said backer plates are attached to said blocks and said inner plates and said backer plates are configured to define a gap therebetween, thereby providing a thermal break.

* * * * *